US007174722B2

(12) United States Patent
Bhatti

(10) Patent No.: US 7,174,722 B2
(45) Date of Patent: Feb. 13, 2007

(54) STIRLING CYCLE BEVERAGE COOLER

(75) Inventor: Mohinder Singh Bhatti, Amherst, NY (US)

(73) Assignee: Delphi Technologies, Inc., Troy, MI (US)

( * ) Notice: Subject to any disclaimer, the term of this patent is extended or adjusted under 35 U.S.C. 154(b) by 192 days.

(21) Appl. No.: 11/041,812

(22) Filed: Jan. 24, 2005

(65) Prior Publication Data

US 2006/0162346 A1 Jul. 27, 2006

(51) Int. Cl.
*F25B 9/00* (2006.01)

(52) U.S. Cl. ..... 62/6

(58) Field of Classification Search ..... 62/6, 62/238.2, 393, 430, 434, 436; 261/97, 110
See application file for complete search history.

(56) References Cited

U.S. PATENT DOCUMENTS 3,285,058 A * 11/1966 Ostroot ..... 73/54.35
3,613,781 A * 10/1971 Barratt ..... 165/145
4,259,182 A * 3/1981 Belveal ..... 210/629
4,430,042 A * 2/1984 House ..... 415/1
4,622,687 A * 11/1986 Whitaker et al. ..... 378/130
5,496,149 A * 3/1996 Dugan ..... 415/90
6,195,443 B1 * 2/2001 Hammond et al. ..... 382/100
6,347,524 B1 * 2/2002 Barrash et al. ..... 62/6
6,378,313 B2 * 4/2002 Barrash ..... 62/6
6,422,025 B1 * 7/2002 Rudick et al. ..... 62/6
6,481,216 B2 * 11/2002 Simmons et al. ..... 62/6
6,532,749 B2 * 3/2003 Rudick et al. ..... 62/6
7,074,372 B2 * 7/2006 Muldowney et al. ..... 422/194

* cited by examiner

*Primary Examiner*—Mohammad M. Ali
(74) *Attorney, Agent, or Firm*—Patrick M. Griffin

(57) ABSTRACT

The invention provides a heat exchanger operable, for example, with Stirling cooling system. The heat exchanger includes a first member having an inner surface defining a flow path for a working fluid. The first member also includes an outer surface spaced from the inner surface. The heat exchanger also includes a second member cooperating with the first member to define a first substantially enclosed heat exchanging chamber having a height and extending along at least a portion of the outer surface. The heat exchanger also includes at least one first blind conduit including an opening communicating with the first substantially enclosed heat exchanging chamber and a distal end spaced from the opening. The second member and the at least one first blind conduit cooperate with one another to define an enclosed path for a two-phase fluid to move along back and forth between the outer surface and the distal end.

27 Claims, 4 Drawing Sheets

STIRLING CYCLE BEVERAGE COOLER

FIELD OF THE INVENTION

The invention relates to a heat exchanger and more particularly to a heat exchanger for defining an enclosed path for movement of a refrigerant operable to change phase at relatively low temperatures.

BACKGROUND OF THE INVENTION

Heat exchangers often define a wall separating two fluids with different levels of energy, as demonstrated by different temperatures for example. Thermal energy, or heat, is transferred from the fluid at higher temperature, through the wall, to fluid at lower temperature.

Stirling cooling systems can incorporate heat exchangers. A Stirling cooling system, or Stirling heat transfer system, applies compression and expansion to a compressible working fluid to transfer heat. Usually the working fluid is helium or hydrogen. The Stirling system includes an elongate tube or conduit, a pair of pistons moving in the tube, and regenerating member disposed between the pistons. The pistons are moved together and relative to one another to compress and expand the fluid. As a result of the coordinated movement of the pistons, one end of the tube rejects heat and the opposite end of the tube absorbs heat. Heat exchangers can be disposed at both ends to enhance the transfer of thermal energy.

SUMMARY OF THE INVENTION AND ADVANTAGES

The invention provides a heat exchanger operable, for example, with Stirling cooling system. The heat exchanger includes a first member having an inner surface defining a flow path for a working fluid. The first member also includes an outer surface spaced from the inner surface. The heat exchanger also includes a second member cooperating with the first member to define a first substantially enclosed heat exchanging chamber having a height and extending along at least a portion of the outer surface. The heat exchanger also includes at least one first blind conduit including an opening communicating with the first substantially enclosed heat exchanging chamber and a distal end spaced from the opening. The second member and the at least one first blind conduit cooperate with one another to define an enclosed path for a two-phase fluid, such as R-134a or R-744 for example, to move along back and forth between the outer surface and the distal end. The two-phase fluid is capable of transforming between liquid phase and vapor phase in response to heat transfer at relatively low temperatures. A third fluid, such as air or water can flow around the outside of the at least one blind conduit to exchange thermal energy with the two-phase fluid.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
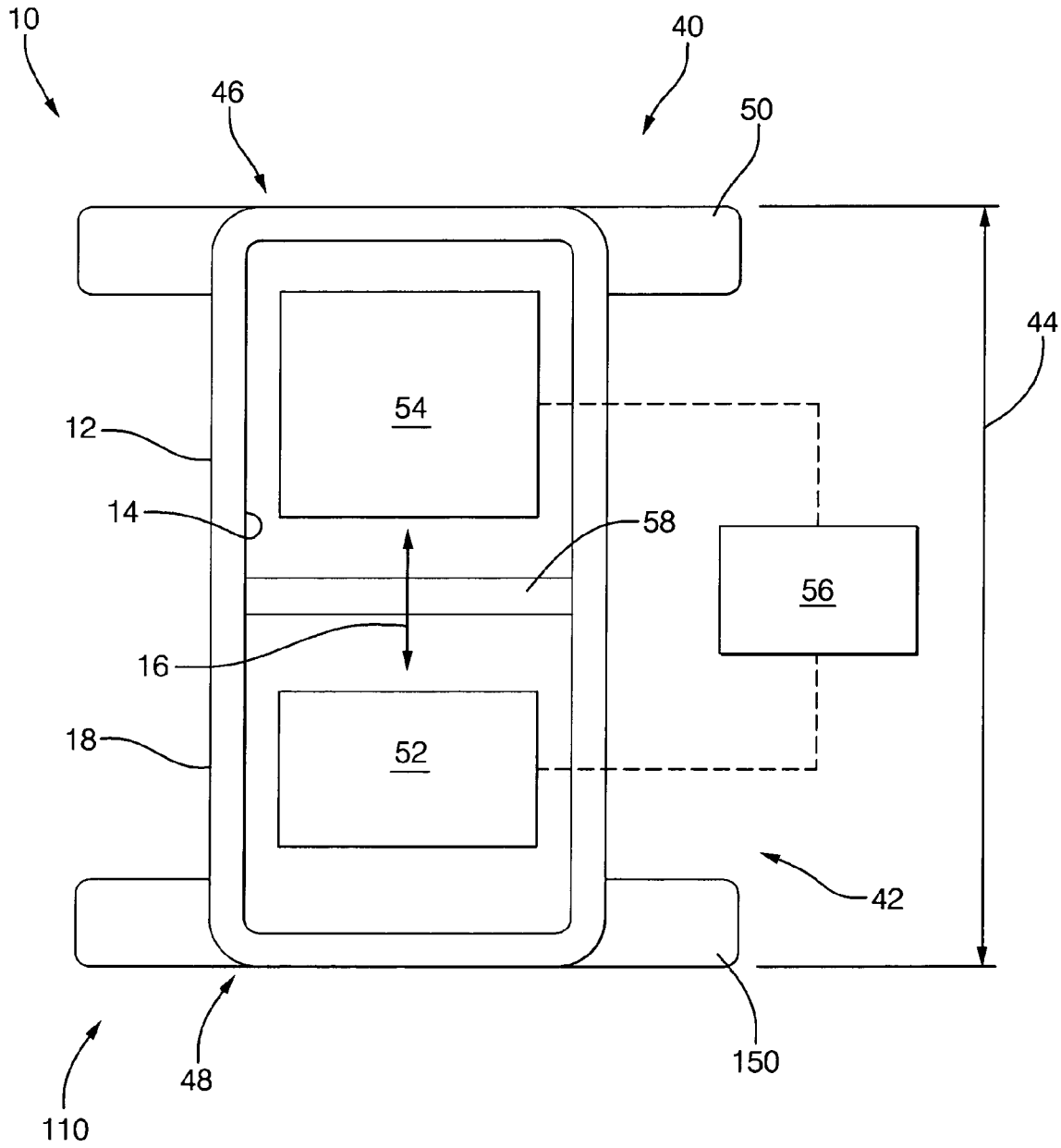
FIG. 1 is a schematic view of a Stirling cooling system according to an embodiment of the invention.

A plurality of different embodiments of the invention are shown in the Figures of the application. Similar features are shown in the various embodiments of the invention. Similar features have been numbered with a common two-digit reference numeral and have been differentiated by a third digit placed before the two common digits. Similar features are structured similarly, operate similarly, and/or have the same function unless otherwise indicated by the drawings or this specification. Furthermore, particular features of one embodiment can replace corresponding features in another embodiment unless otherwise indicated by the drawings or this specification.

Figure 2:
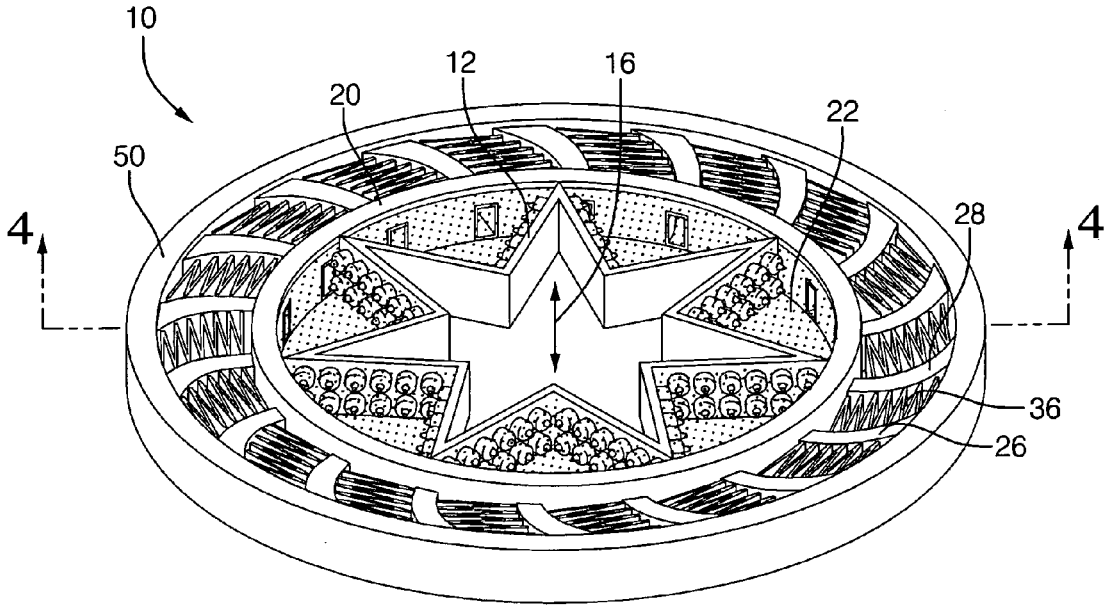
FIG. 2 is a perspective view of a first heat exchanger according to an embodiment of the invention, the heat exchanger being part of the Stirling cooling system of FIG. 1.
Figure 3:
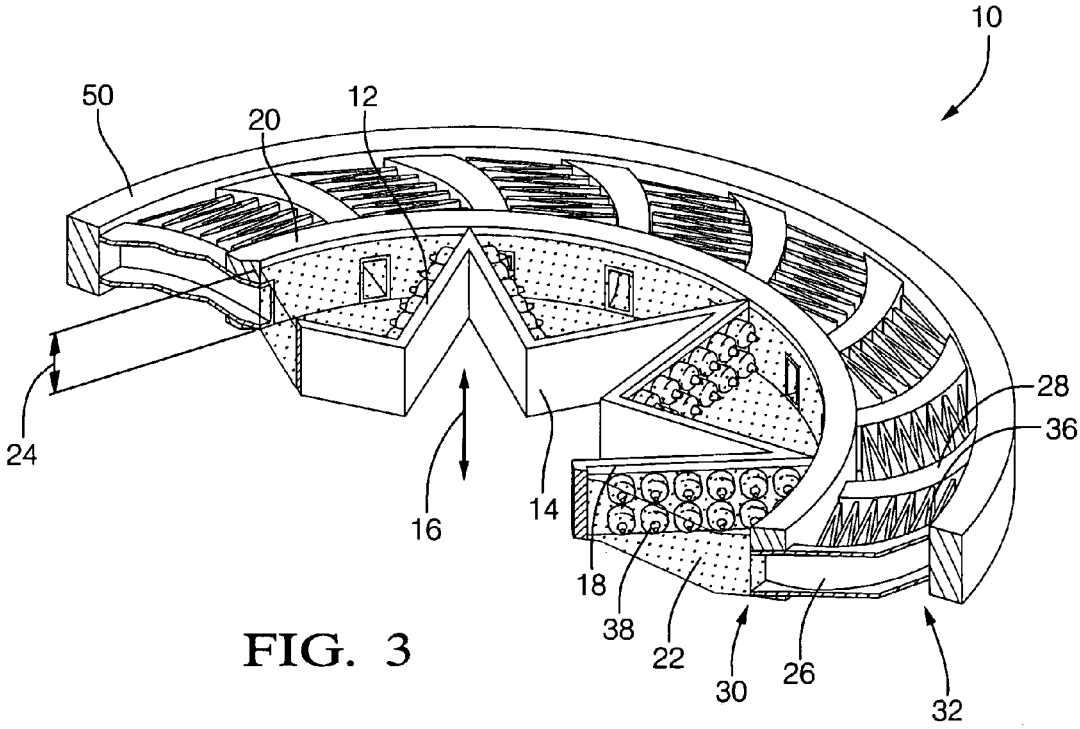
FIG. 3 is a perspective cross-sectional view of the first heat exchanger.
Figure 4:
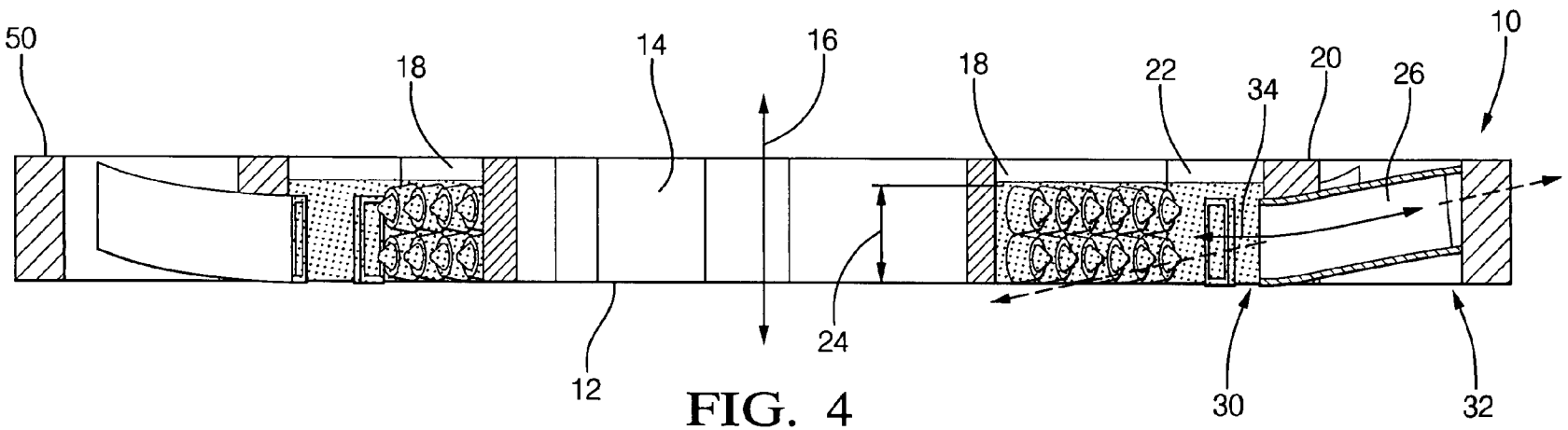
FIG. 4 is a side view of the cross-section exposed in FIG. 3.

Referring now to FIGS. 2–4, the invention provides a heat exchanger 10. The heat exchanger 10 includes a first member 12 having an inner surface 14 defining a flow path 16 for a working fluid. The working fluid can be any fluid used in a Stirling cycle application, examples include helium and hydrogen. The first member 12 also includes an outer surface 18 spaced from the inner surface 14. The heat exchanger 10 also includes a second member 20 cooperating with the first member 12 to define a first substantially enclosed heat exchanging chamber 22 having a height 24 and extending along at least a portion of the outer surface 18. The heat exchanger 10 also includes at least one first blind conduit 26 including an opening 30 communicating with the first substantially enclosed heat exchanging chamber 22 and a distal end 32 spaced from the opening 30. The second member 20 and the at least one first blind conduit 26 cooperate with one another to define an enclosed path 34 for a two-phase fluid to move along back and forth between the outer surface 18 and the distal end 32. The two-phase fluid is operable to change phase at relatively low temperature in response to thermal energy exchange. For example, the two-phase fluid can change from liquid phase to vapor phase in response to receiving or absorbing thermal energy and change from vapor phase to liquid phase in response to rejecting or losing thermal energy. Examples of two-phase fluids include R-134a and R-744.

In the exemplary embodiment of the invention, the first substantially enclosed heat exchanging chamber 22 encircles the outer surface 18 and the first and second members 12, 20 are aligned along the flow path 16. The flow path 16 extends parallel to the height 24. An outer ring 50 supports the distal end 32 of the first blind conduit 26. The first member 12 defines a star-shaped cross-section normal to the flow path 16 and the second member 20 defines a circular cross-section normal to the flow path 16.

The first blind conduit 26 of the exemplary embodiment of the invention extends between normal and parallel to the height 24. In other words, the first blind conduit 26 extends at an angle of less than ninety degrees to the height 24 and more than angle of zero degrees to the height 24. The inner surface of the first blind conduit 26 slopes upwardly to define the flow path 34. The first blind conduit 26 of the exemplary embodiment of the invention extends along a helical path between the opening 30 and the distal end 32. The heat exchanger 10 is a heat rejecter wherein a two-phase fluid disposed in the first substantially enclosed heat exchanging chamber 22 absorbs thermal energy from the outer surface 18 of the first member 12 and changes a phase from liquid to vapor. The vaporized two-phase fluid moves from the first substantially enclosed heat exchanging chamber 22 along the path 34 defined by the first blind conduit 26. During movement along the path 34, thermal energy is transferred from the two-phase fluid and the two-phase fluid changes phases from vapor to liquid. The shape of the path 34, defined by the shape of the conduit 26, forms a downwardly sloped path from the distal end 32 to the first substantially enclosed heat exchanging chamber 22 and the condensed two-phase fluid flows back to the first substantially enclosed heat exchanging chamber 22 and the process is repeated.

In the exemplary embodiment of the invention, the at least one first blind conduit 26 further comprises a plurality of first blind conduits 26, 28 evenly spaced from one another along the second member 20. Each of the first blind conduits 26, 28 individually communicate with the first substantially enclosed heat exchanging chamber 22. Each of the first blind conduits 26, 28 include an opening 30 communicating with the first substantially enclosed heat exchanging chamber 22 and a distal end 32 radially spaced from the opening 30 to define a plurality of enclosed paths 34 extending radially away from the outer surface 18 for a two-phase fluid to radially move along back and forth between the outer surface 18 and the distal end 32. Each of the first blind conduits 26, 28 extends between normal and parallel to the height 24. The plurality of first blind conduits 26, 28 extend parallel to one another along respective, parallel helical paths between the openings 30 and the distal ends 32. The gap between adjacent conduits 26, 28 is substantially constant between the openings 30 and the distal ends 32, enhancing heat transfer. Also, a plurality of fins 36 extend between adjacent pairs of the plurality of first blind conduits 26, 28. Since the gap between adjacent conduits 26, 28 is substantially constant, the fins 36 can be similarly sized, enhancing cost and assembly. A single-phase fluid, like air or water, flowing through fins 36 removes heat from the vapor of the two-phase fluid inside the blind conduits 26, 28 thereby condensing the vapor to liquid. The condensed liquid flows from the blind conduits 26, 28 into the chamber 22 by gravity to continue the liquid-to-vapor transformation cycle in the chamber 22.

Heat transfer is further enhanced by a plurality of projections 38 extending from the outer surface 18 into the first substantially enclosed heat exchanging chamber 22. The plurality of projections 38 are pyramid shaped. The plurality of projections 38 increase the surface area over which heat is transferred.

Figure 7:
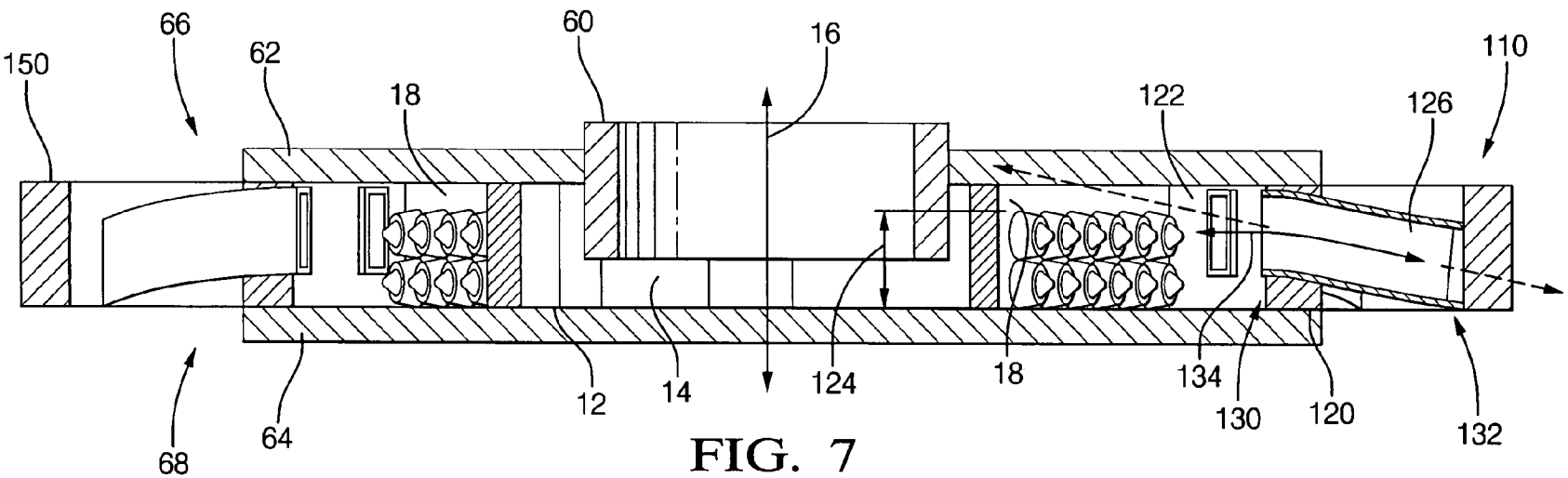
FIG. 7 is a side view of the cross-section exposed in FIG. 6.
Figure 5:
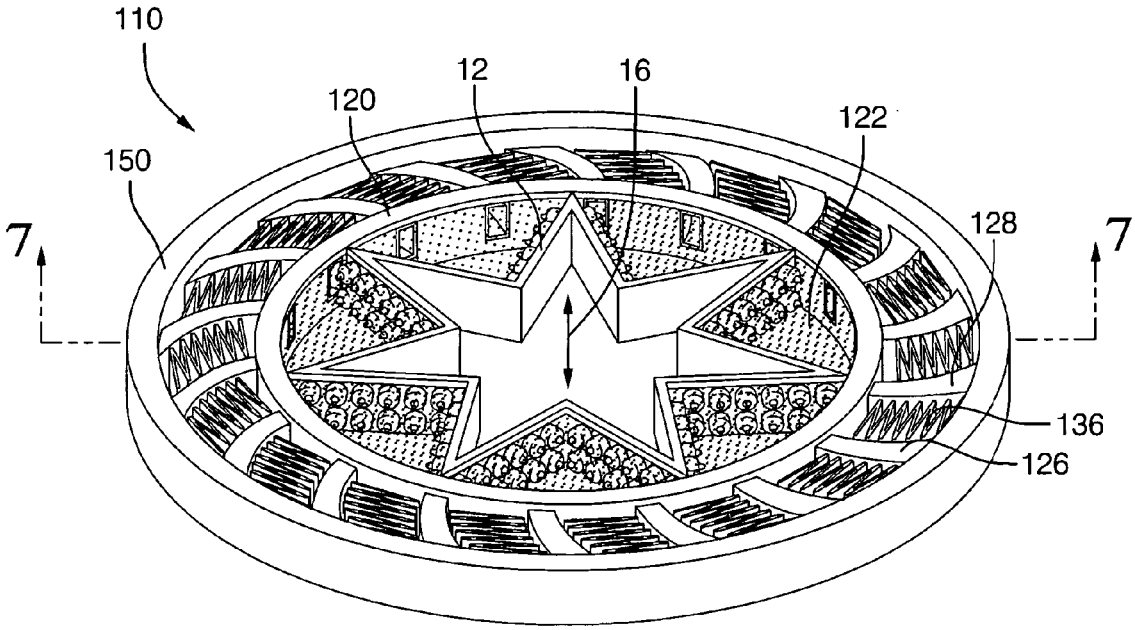
FIG. 5 is a perspective view of a second heat exchanger according to an embodiment of the invention, the heat exchanger being part of the Stirling cooling system of FIG. 1.
Figure 6:
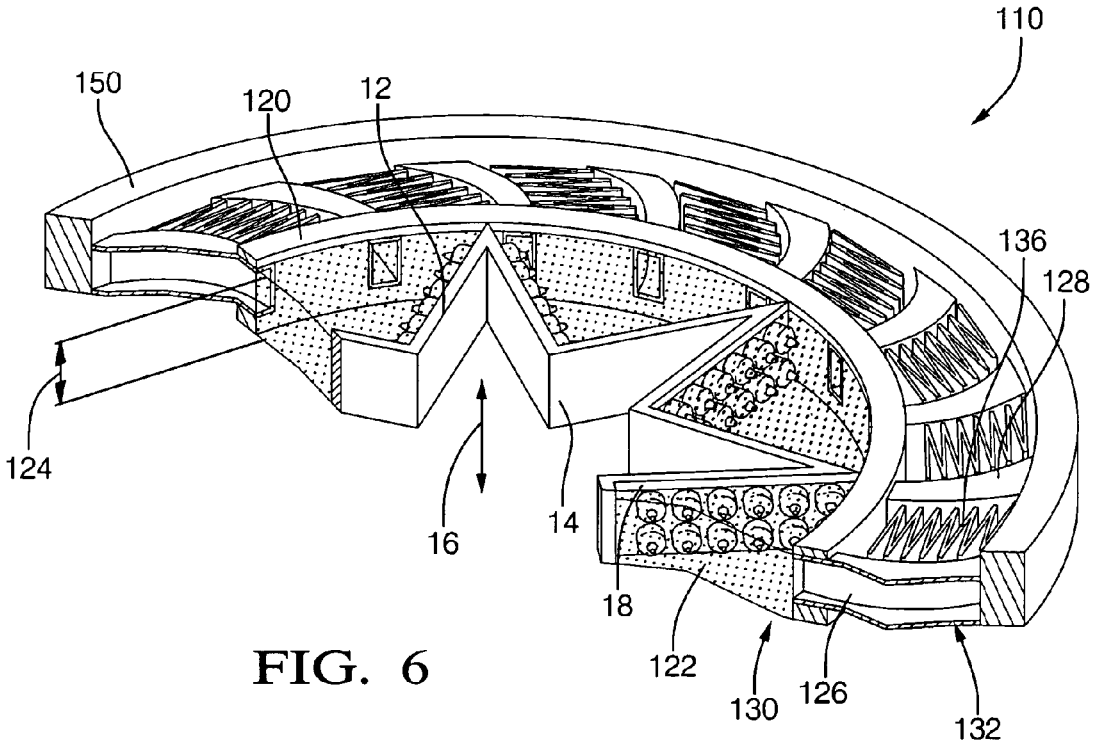
FIG. 6 is a perspective cross-sectional view of the second heat exchanger.

Referring now to FIGS. 5–7, the invention also provides a heat exchanger 110. The heat exchanger 110 includes the first member 12 having the inner surface 14 defining the flow path 16 for the working fluid. The working fluid in the exemplary embodiments of the invention is compressible and expandable. The first member 12 also includes the outer surface 18 spaced from the inner surface 14. The heat exchanger 110 also includes a third member 120 spaced from the second member 20 along the flow path 16 and cooperating with the first member 12 to define a second substantially enclosed heat exchanging chamber 122 having a second height 124 and extending along at least a portion of the outer surface 18. A second two-phase fluid is disposed in the second substantially enclosed heat exchanging chamber 122. The second two-phase fluid operates the same as the first phase fluid; examples of the second two-phase fluid include R-134a and R-744. The heat exchanger 110 also includes at least one second blind conduit 126 including a second opening 130 communicating with the second substantially enclosed heat exchanging chamber 122 and a second distal end 132 spaced from the second opening 130. The third member 120 and the at least one second blind conduit 126 cooperate with one another to define a second enclosed path 134 for the second two-phase fluid to move along back and forth between the outer surface 18 and the second distal end 132. An outer ring 150 supports the distal end 32 of the first blind conduit 26.

The second blind conduit 126 of the exemplary embodiment of the invention extends between normal and parallel to the height 124. In other words, the second blind conduit 126 extends at an angle of less than ninety degrees to the height 124 and more than angle of zero degrees to the height 124. The inner surface of the second blind conduit 126 slopes downwardly to define the flow path 134. The second blind conduit 126 of the exemplary embodiment of the invention extends along a helical path between the opening 130 and the distal end 132. The heat exchanger 110 is a heat accepter wherein the second two-phase fluid disposed in the second substantially enclosed heat exchanging chamber 122 loses thermal energy to the outer surface 18 of the first member 12 and changes a phase from vapor to liquid. The condensed second two-phase fluid moves from the second substantially enclosed heat exchanging chamber 122 along the path 134 defined by the second blind conduit 126. The second blind conduit slopes downwardly from the opening 130 to the distal end 132 and the condensed second two-phase fluid flows downward, by gravity. During movement along the path 134, thermal energy is transferred to the second two-phase fluid and the second two-phase fluid changes phases from liquid to vapor. Thermal energy is transferred to the second two-phase fluid from a fourth fluid flowing around the conduit 126. The fourth fluid is similar to the third fluid described above. Examples of a fourth fluid include air and water. The shape the path 134, defined by the shape of the conduit 126, forms an upwardly sloped path from the distal end 132 to the second substantially enclosed heat exchanging chamber 122 and the vaporized second two-phase fluid flows back to the second substantially enclosed heat exchanging chamber 122 to continue the cycle of vapor-to-liquid transformation in the second substantially enclosed heat exchanging chamber 122.

The heat exchangers 10, 110 are used in combination in a Stirling cooling system 40 shown in FIG. 1. The Stirling cooling system 40 includes a Stirling propulsive mechanism 42, such as a linear motion motor, for compressing and expanding the working fluid. The mechanism 42 includes first and second pistons 54, 56 disposed for cooperating movement to compress and expand the working fluid. The piston 54 is also referred to as a displacer in the art. The mechanism 42 also includes a mover 56, such as a magnetic motor and appropriate linkages between the motor and the pistons 54, 56, to move the pistons 54, 56 in reciprocating motion as known for Stirling cycles. The mechanism 42 also includes a regenerator 58 disposed between the pistons 54, 56. The first member 12 substantially encloses the Stirling cooling mechanism 42 and extends a third height 44 between a first end 46 absorbing thermal energy and a second end 48 emitting thermal energy. The second member 20 is adjacent to and cooperates with the first ends 46 of the first member 12 to define the first substantially enclosed heat exchanging chamber 22. The plurality of first blind conduits 26, 28 each include a respective opening 30 communicating with the first substantially enclosed heat exchanging chamber 22 and have a distal end 32 radially spaced from the opening 30. The second member 20 and the plurality of first blind conduits 26, 28 cooperate with one another to define a plurality of enclosed paths 34 extending radially away from the outer surface 18 for a two-phase fluid to radially move along back and forth between the outer surface 18 and the distal ends 32.

The Stirling cooling system 40 also includes the third member 120 disposed adjacent to and cooperating with the second end 48 of the first member 12 to define a second substantially enclosed heat exchanging chamber 122 having a second height 124. The first and second heights 24, 124 are parallel to one another. The plurality of second blind conduits 126, 128 each include a respective second opening 130 communicating with the second substantially enclosed heat exchanging chamber 122 and a second distal end 132 spaced from the second opening 130. Fins 136 extend between adjacent conduits 126, 128. The third member 120 and the plurality of second blind conduits 126, 128 cooperate with one another to define the plurality of second enclosed paths 134 extending radially away from the outer surface 18 for the second two-phase fluid to radially move along back and forth between the outer surface 18 and the second distal ends 132.

Each of the pluralities of first and second blind conduits 26, 28, 126, 128 extend between normal and parallel to respective the first and second heights 24, 124. The plurality of first blind conduits 26, 28 extending in opposite direction with respect to the plurality of second blind conduits 126, 128 relative to respective the first and second heights 24, 124. In other words, the plurality of first blind conduits 26, 28 extend upwardly and the plurality of second blind conduits 126, 128 extend downwardly.

FIG. 1 shows a schematic view of the Stirling cooling system 40 and FIG. 7 shows one alternative embodiment structure for engaging the heat exchanger 110 and the first member 12 with respect to one another. The engaging structure includes a cylindrical ring 60 that guides movement of the piston 52 relative to the member 12. The ring 60 is not shown in other views to enhance the clarity of the drawings. The member 12 is shown extending the entire height of the system 40 in FIG. 1. However, the member 12 may only extend height of the heat exchanger 110. In such an embodiment of the invention, the ring 60 could be part of a Stirling system having an elongate cylindrical member for guiding movement of the pistons 52, 54 and the ring 60 could be aligned with the elongate cylindrical member and/or be integral with the elongate cylindrical member. The ring 60 extends into the member 12 such that the working fluid can move around the ring 60 to the perimeter of the member 12. The piston 52 is guided in movement by the ring 60 and can, at least partially move into the star-shaped cavity defined by the member 12. The ring 60 is centered with respect to the heat exchanger 110. The ring 60 can be engaged and/or integral with a plate 62 that closes one side of the chamber 122. A second plate 64 can close a second side of the chamber 122. The plates 62, 64 extend such that flow of the fourth fluid described above, as indicated by one or both of arrows 66 and 68, over the fins 136 and the blind conduits 126, 128, is not blocked. Although not shown, structure that operates similarly to the ring 60 and plates 62, 64 can be associated with the heat exchanger 10.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A heat exchanger comprising:

a first member having an inner surface defining a flow path for a working fluid and an outer surface spaced from said inner surface;

a second member cooperating with said first member to define a first substantially enclosed heat exchanging chamber having a height and extending along at least a portion of said outer surface; and at least one first blind conduit including an opening communicating with said first substantially enclosed heat exchanging chamber and a distal end spaced from said opening, said second member and said at least one first blind conduit cooperating with one another to define an enclosed path for a two-phase fluid to move along back and forth between said outer surface and said distal end.

2. The heat exchanger of claim 1 wherein said at least one first blind conduit extends between normal and parallel to said height.

3. The heat exchanger of claim 2 wherein said at least one first blind conduit extends along a helical path between said opening and said distal end.

4. The heat exchanger of claim 1 wherein said at least one first blind conduit further comprises:

a plurality of first blind conduits evenly spaced from one another along said second member and individually communicating with said first substantially enclosed heat exchanging chamber.

5. The heat exchanger of claim 4 wherein each of said plurality of first blind conduits extends between normal and parallel to said height.

6. The heat exchanger of claim 5 wherein said plurality of first blind conduits extend parallel to one another.

7. The heat exchanger of claim 6 further comprising:

a plurality of fins extending between adjacent pairs of said plurality of first blind conduits.

8. The heat exchanger of claim 1 wherein said first substantially enclosed heat exchanging chamber encircles said outer surface.

9. The heat exchanger of claim 1 wherein said first member defines a star-shaped cross-section.

10. The heat exchanger of claim 1 further comprising:

a plurality of projections extending from said outer surface into said first substantially enclosed heat exchanging chamber.

11. The heat exchanger of claim 1 wherein each of said plurality of projections are pyramid shaped.

12. The heat exchanger of claim 1 wherein said flow path extends parallel to said height.

13. The heat exchanger of claim 1 further comprising:

a third member spaced from said second member along said flow path and cooperating with said first member to define a second substantially enclosed heat exchanging chamber having a second height and extending along at least a portion of said outer surface; and at least one second blind conduit including a second opening communicating with said second substantially enclosed heat exchanging chamber and a second distal end spaced from said second opening, said third member and said at least one second blind conduit cooperating with one another to define a second enclosed path for a second two-phase fluid to move along back and forth between said outer surface and said second distal end.

14. The heat exchanger of claim 13 wherein both of said at least one second blind conduit and said at least one first blind conduit extend between normal and parallel to respective said heights.

15. The heat exchanger of claim 13 wherein said at least one second blind conduit and said at least one first blind conduit extend in opposite directions with respect to one another relative to said flow path.

16. A method for exchanging heat comprising the steps of:

first changing a phase of a two-phase fluid from a first phase to a second phase by transferring thermal energy between the two-phase fluid and an outer surface of a first member;

first directing the two-phase fluid in a first direction away from the outer surface along an enclosed sloped path defined by at least one first blind conduit extending from an opening to a distal end after said first changing step;

second changing the phase of the two-phase fluid from the second phase to the first phase by transferring thermal energy between the two-phase fluid and the at least one first blind conduit during said first directing step; and second directing the two-phase fluid in a second direction opposite the first direction along the enclosed sloped path after said second changing step.

17. The method of claim 16 wherein said first changing step is further defined as:

first changing the phase of the two-phase fluid from liquid to vapor by transferring thermal energy to the two-phase fluid from the outer surface of a first member.

18. The method of claim 17 wherein said second changing step is further defined as:

second changing the phase of the two-phase fluid from vapor to liquid by transferring thermal energy from the two-phase fluid to the at least one first blind conduit during said first directing step.

19. The method of claim 18 wherein said first directing step is further defined as:

first directing the thermal fluid in a first direction away from the outer surface along an enclosed upwardly-sloped path defined by the at least one first blind conduit to the distal end after said first changing step.

20. The method of claim 16 including the step of:

moving an expandable and compressible working fluid through the first member along the flow path to transfer thermal energy; and encircling the first member with the two-phase fluid.

21. A heat exchanger comprising:

a first member having an inner surface defining a flow path for a working fluid and an outer surface spaced from said inner surface;

a second member cooperating with and encircling said first member to define a first substantially enclosed heat exchanging chamber having a height, said first and second members being aligned along said flow path; and a plurality of first blind conduits each including an opening communicating with said first substantially enclosed heat exchanging chamber and a distal end radially spaced from said opening, said second member and said plurality of first blind conduits cooperating with one another to define a plurality of enclosed paths extending radially away from said outer surface for a two-phase fluid to radially move along back and forth between said outer surface and said distal end.

22. The heat exchanger of claim 21 wherein each of said plurality of first blind conduits extend between normal and parallel to said height.

23. The heat exchanger of claim 22 wherein each of said plurality of first blind conduits extend along respective, parallel helical paths between said openings and said distal ends.

24. The heat exchanger of claim 23 further comprising:

a plurality of fins extending between each adjacent pair of said plurality of first blind conduits.

25. The heat exchanger of claim 24 wherein said first member defines a star-shaped cross-section normal to said flow path and said second member defines a circular cross-section normal to said flow path.

26. A Stirling cooling system comprising:

a Stirling propulsive mechanism for compressing and expanding a working fluid;

a first member substantially enclosing said Stirling cooling mechanism and having an inner surface defining a flow path for the working fluid and an outer surface spaced from said inner surface, said first member extending a third height between a first end emitting thermal energy and a second end absorbing thermal energy;

a second member disposed adjacent to and cooperating with one of said first and second ends of said first member to define a first substantially enclosed heat exchanging chamber having a height, said first and second members being aligned along said flow path;

a plurality of first blind conduits each including an opening communicating with said first substantially enclosed heat exchanging chamber and a distal end radially spaced from said opening, said second member and said plurality of first blind conduits cooperating with one another to define a plurality of enclosed paths extending radially away from said outer surface for a two-phase fluid to radially move along back and forth between said outer surface and said distal ends;

a third member disposed adjacent to and cooperating with the other of said first and second ends of said first member to define a second substantially enclosed heat exchanging chamber having a second height, said first and second heights being parallel to one another; and a plurality of second blind conduits each including a second opening communicating with said second substantially enclosed heat exchanging chamber and a second distal end spaced from said second opening, said third member and said plurality of second blind conduits cooperating with one another to define a plurality of second enclosed paths extending radially away from said outer surface for a second two-phase fluid to radially move along back and forth between said outer surface and said second distal ends, each of said pluralities of first and second blind conduits extending between normal and parallel to respective said first and second heights and said plurality of first blind conduits extending in opposite direction with respect to said plurality of second blind conduits relative to respective said first and second heights.

27. The Stirling cooling system of claim 26 wherein said second and third members define circular cross-sections and said pluralities of first and second blind conduits extend radially from and are spaced circumferentially about said respective second and third members.

* * * * *